US009572220B2

(12) United States Patent
Kim et al.

(10) Patent No.: US 9,572,220 B2
(45) Date of Patent: Feb. 14, 2017

(54) LED LIGHTING APPARATUS AND CONTROL CIRCUIT THEREOF

(71) Applicant: SILICON WORKS CO., LTD., Daejeon (KR)

(72) Inventors: Yong Goo Kim, Daejeon-si (KR); Won Ji Lee, Cheonahn-si (KR); Kyung Min Kim, Daejeon-si (KR); Jong Min Lee, Busan (KR); Min Soo Kim, Chungcheongbuk-do (KR); Young Suk Son, Daejeon (KR)

(73) Assignee: SILICON WORKS CO., LTD., Daejeon (KR)

( * ) Notice: Subject to any disclaimer, the term of this patent is extended or adjusted under 35 U.S.C. 154(b) by 0 days.

(21) Appl. No.: 14/901,544

(22) PCT Filed: Jun. 25, 2014

(86) PCT No.: PCT/KR2014/005628
§ 371 (c)(1),
(2) Date: Dec. 28, 2015

(87) PCT Pub. No.: WO2014/209009
PCT Pub. Date: Dec. 31, 2014

(65) Prior Publication Data

US 2016/0143107 A1 May 19, 2016

(30) Foreign Application Priority Data

Jun. 28, 2013 (KR) ..... 10-2013-0075422

(51) Int. Cl.
*H05B 33/08* (2006.01)

(52) U.S. Cl.
CPC ..... *H05B 33/0851* (2013.01); *H05B 33/0824* (2013.01); *H05B 33/0887* (2013.01)

(58) Field of Classification Search
CPC ..... H05B 33/0815; H05B 33/0818; H05B 33/0884; H05B 33/0809; H05B 33/0848; H05B 33/0896
(Continued)

(56) References Cited

U.S. PATENT DOCUMENTS 4,593,232 A * 6/1986 McEdwards ..... H05B 39/09 315/199
2002/0140373 A1* 10/2002 Ribarich ..... H05B 41/2855 315/224
(Continued)

FOREIGN PATENT DOCUMENTS

KR 10-2011-0051062 5/2011
KR 10-2012-0008004 1/2012
KR 10-2013-0013221 2/2013

OTHER PUBLICATIONS

International Search Report for International Application No. PCT/KR2014/005628, dated Oct. 21, 2014.
(Continued)

*Primary Examiner* — Douglas W Owens
*Assistant Examiner* — Syed M Kaiser
(74) *Attorney, Agent, or Firm* — Kile Park Reed & Houtteman PLLC

(57) ABSTRACT

Disclosed are an LED lighting apparatus and a control circuit thereof which controls illumination of a lamp including LEDs using a dimmer. The LED lighting apparatus includes a flicker control unit which provides a control signal corresponding to a rectified voltage having a low angle corresponding to a preset low angle region and equal to or less than a preset level or detects an initial abnormal waveform diagram of the rectified voltage and provides a control signal corresponding to the abnormal waveform period, and controls a current path for light emission of the lamp.

14 Claims, 4 Drawing Sheets

(58) Field of Classification Search
USPC ..... 315/246, 294, 297, 307, 224, 121
See application file for complete search history.

(56) References Cited

U.S. PATENT DOCUMENTS

| | | | | |
|---|---|---|---|---|
| 2011/0227489 | A1 | 9/2011 | Huynh | |
| 2012/0013265 | A1 | 1/2012 | Yang et al. | |
| 2012/0319604 | A1* | 12/2012 | Walters | H02M 3/1582<br>315/200 R |
| 2014/0361695 | A1* | 12/2014 | Akiyama | H05B 33/0812<br>315/185 R |
| 2015/0163873 | A1* | 6/2015 | Kawai | H05B 33/0815<br>315/127 |

OTHER PUBLICATIONS

Written Opinion for International Application No. PCT/KR2014/005628, dated Oct. 21, 2014.

* cited by examiner

LED LIGHTING APPARATUS AND CONTROL CIRCUIT THEREOF

TECHNICAL FIELD

The present disclosure relates to an LED lighting apparatus, and more particularly, to an LED lighting apparatus and a control circuit thereof which controls illumination of a lamp including LEDs using a dimmer.

BACKGROUND ART

According to the recent trend of lighting technology, an LED has been employed as a light source, in order to reduce energy.

A high-brightness LED is differentiated from other light sources in terms of various aspects such as energy consumption, lifetime, and light quality.

However, since the LED is driven by a current, a lighting apparatus using the LED as a light source requires a large number of additional circuits for current driving.

In order to solve the above-described problem, an AC direct-type lighting apparatus has been developed.

The AC direct-type LED lighting apparatus generates a rectified voltage using a commercial AC power supply and drives an LED. Since the AC direct-type LED lighting apparatus directly uses the rectified voltage as an input voltage without using an inductor and capacitor, the AC direct-type LED lighting apparatus has a satisfactory power factor.

A general LED lighting apparatus is designed to be driven through a voltage obtained by rectifying commercial power having an AC voltage.

A lamp of the LED lighting apparatus includes a large number of LEDs connected in series to each other, and controls the LEDs connected in series to emit light using the rectified voltage.

Recently, the LED lighting apparatus has employed a dimmer using a triac, in order to control brightness. The dimmer is generally used to control the brightness of an incandescent lamp.

When the dimmer is applied to the LED lighting apparatus, there may occur a difference between a design value of the LED lighting apparatus and the characteristic of the triac used as a part of the dimmer.

The triac of the dimmer has a holding current which may be changed in response to the characteristic difference. Thus, when a low-angle rectified voltage is provided to the LED lighting apparatus employing the dimmer including the triac, an insufficient level thereof may cause a flicker.

Furthermore, according to the characteristic and use environment of the triac included in the dimmer, a rectified voltage having an abnormal waveform may be inputted to the lamp at the initial stage.

When the rectified voltage having an abnormal waveform is inputted to the lamp, a flicker may occur in the initial state where the LED lighting apparatus is driven.

The conventional LED lighting apparatus must reduce the occurrence of the flicker, in order to perform the brightness control function using the dimmer including the triac.

DISCLOSURE

Technical Problem

Various embodiments are directed to an LED lighting apparatus and a control circuit thereof which employs a dimmer using a triac to perform a brightness control function and is capable of reducing flicker which occurs in a low angle region of a rectified voltage.

Also, various embodiments are directed to an LED lighting apparatus and a control circuit thereof which employs a dimmer using a triac to perform a brightness control function and is capable of reducing flicker by skipping an initial abnormal waveform of a rectified voltage.

Technical Solution

In an embodiment, there is provided a control circuit of an LED lighting apparatus, which controls a lamp divided into a plurality of LED groups to emit light in response to a rectified voltage outputted through a dimmer using a triac. The control circuit may include: a reference voltage supply unit configured to provide reference voltages having different levels to the respective LED groups; a flicker control unit configured to provide a control signal in response to the rectified voltage having a low angle corresponding to a preset low angle region and equal to or less than a preset level; and a plurality of switching circuits configured to selectively provide a current path in response to light emission of the LED groups, perform current regulation for selectively providing the current path by comparing the reference voltages of the respective LED groups to a current sensing voltage corresponding to the current amount of the current path, and turn off the current path in response to the control signal.

In another embodiment, there is provided a control circuit of an LED lighting apparatus, which controls a lamp divided into a plurality of LED groups to emit light in response to a rectified voltage outputted through a dimmer using a triac. The control circuit may include: a reference voltage supply unit configured to provide reference voltages having different levels to the respective LED groups; a flicker control unit configured to detect an initial abnormal waveform period of the rectified voltage and provide a control signal corresponding to the abnormal waveform period; and a plurality of switching circuits configured to selectively provide a current path in response to light emission of the LED groups, perform current regulation for selectively providing the current path by comparing the reference voltages of the respective LED groups to a current sensing voltage corresponding to the current amount of the current path, and turn off the current path during the abnormal waveform period in response to the control signal.

In another embodiment, there is provided a control circuit of an LED lighting apparatus, which controls a lamp divided into a plurality of LED groups to emit light in response to a rectified voltage outputted through a dimmer using a triac. The control circuit may include: a flicker control unit configured to provide a control signal corresponding to the rectified voltage having a low angle corresponding to a preset low angle region and equal to or less than a preset level or detect an initial abnormal waveform period of the rectified voltage and provide a control signal corresponding to the abnormal waveform period; a reference voltage supply unit configured to provide reference voltages having different levels to the respective LED groups, and vary the output levels of the reference voltages in response to the control signal; and a plurality of switching circuits configured to selectively provide a current path in response to light emission of the LED groups, perform current regulation for selectively providing the current path by comparing the reference voltages of the respective LED groups to a current sensing voltage corresponding to the current amount of the current path, and turn off the current path in response to the level changes of the reference voltages by the control signal.

In another embodiment, an LED lighting apparatus may include: a lamp including a plurality of LEDs divided into a plurality of LED groups which sequentially emit light; a power supply unit including a triac and configured to provide a rectified voltage to the lamp using an AC voltage having a phase controlled through the triac; a control circuit configured to selectively provide a current path in response to light emission of the LED groups, provide the current path by comparing reference voltages supplied at different levels to the respective groups to a current sensing voltage corresponding to the current amount of the current path, and turn off the current path in response to the rectified voltage having a low angle corresponding to a preset low angle region and equal to or less than a preset level or detect an initial abnormal waveform period of the rectified voltage and turn off the current path in response to the abnormal waveform period; and a current sensing element configured to provide the current sensing voltage for the current path.

Advantageous Effects

In accordance with the embodiments of the present invention, the LED lighting apparatus and the control circuit can perform the brightness control function through the dimmer using the triac and reduce flicker occurring in the low angle region of the rectified voltage or flicker caused by an initial abnormal waveform of the rectified voltage. The LED lighting apparatus can be stably driven.

MODE FOR INVENTION

Figure 1:
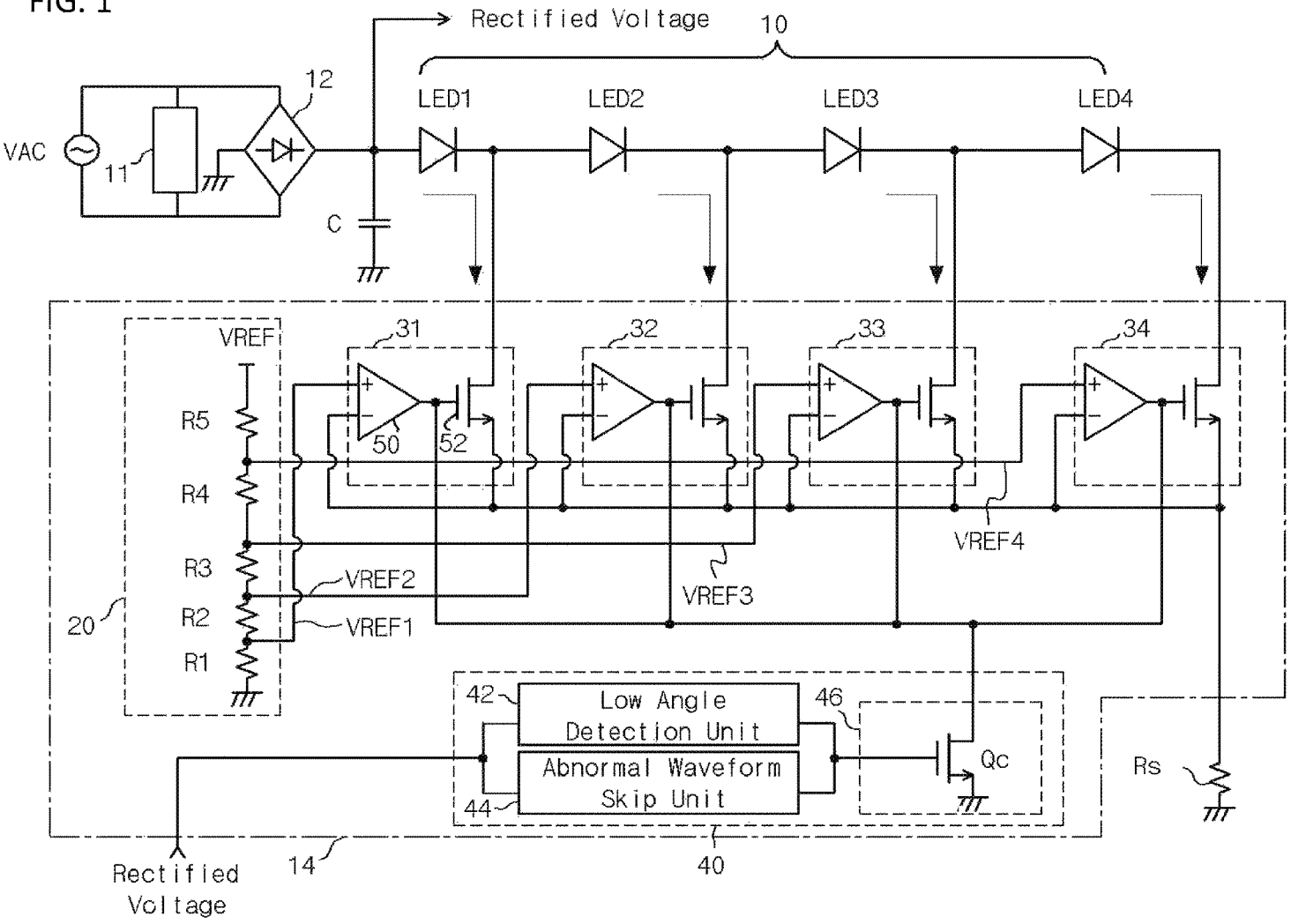
FIG. 1 is a circuit diagram illustrating an LED lighting apparatus and a control circuit thereof in accordance with an embodiment of the present invention.

Hereafter, embodiments of the present invention will be described in detail with reference to the accompanying drawings. The terms used in the present specification and claims are not limited to typical dictionary definitions, but must be interpreted into meanings and concepts which coincide with the technical idea of the present invention.

Embodiments described in the present specification and configurations illustrated in the drawings are preferred embodiments of the present invention, and do not represent the entire technical idea of the present invention. Thus, various equivalents and modifications capable of replacing the embodiments and configurations may be provided at the point of time that the present application is filed.

The embodiments of the present invention disclose a technology for controlling the brightness of a lamp 10 including LEDs by applying a dimmer using a triac to a power supply unit. In the embodiments of the present invention, the dimmer is implemented with a triac 11, but the present invention is not limited thereto.

Referring to FIG. 1, an LED lighting apparatus in accordance with an embodiment of the present invention includes a lamp 10, a power supply unit including a triac 11, and a control circuit. The control circuit has a function of detecting a low-level rectified voltage in a low-angle region or reducing flicker by skipping an abnormal waveform of the rectified voltage at the initial stage, while selectively providing current path for light emission of the lamp 10.

The lamp 10 includes LEDs divided into a plurality of LED groups. As described below with reference to FIG. 2, the LED groups of the lamp 10 are sequentially turned on or off according to a ripple of the rectified voltage supplied from the power supply unit.

FIG. 1 illustrates that the lamp 10 includes four LED groups LED1 to LED4. Each of the LED diode groups LED1 to LED4 may include a plurality of LEDs connected in series, parallel, or serial-parallel to each other. For convenience of description, the plurality of LEDs are represented by one diode symbol.

The power supply unit is configured to rectify an AC voltage introduced from outside and output the rectified voltage.

The power supply unit may include an AC power supply VAC for supplying an AC voltage, the triac 11, a rectifier circuit 12 for outputting the rectified voltage, and a capacitor C for smoothing the rectified voltage outputted from the rectifier circuit 12. The AC power supply VAC may include a commercial power supply.

The triac 11 has a dimming function of controlling the brightness of the lamp 10. The triac 11 may control the phase of the AC voltage transmitted to the rectifier circuit 12 according to control of a user using a control unit (not illustrated) which is separately included in the dimmer, and the brightness of the lamp 10 may be adjusted through the phase control of the AC voltage by the triac 11.

The phase control of the AC voltage by the triac 11 may be performed by controlling conduction timing based on the position at which the zero potential of the sine-wave AC voltage is detected (zero potential detection position). That is, the triac 11 may output an AC voltage to have a phase controlled according to the conduction timing.

Figure 2:
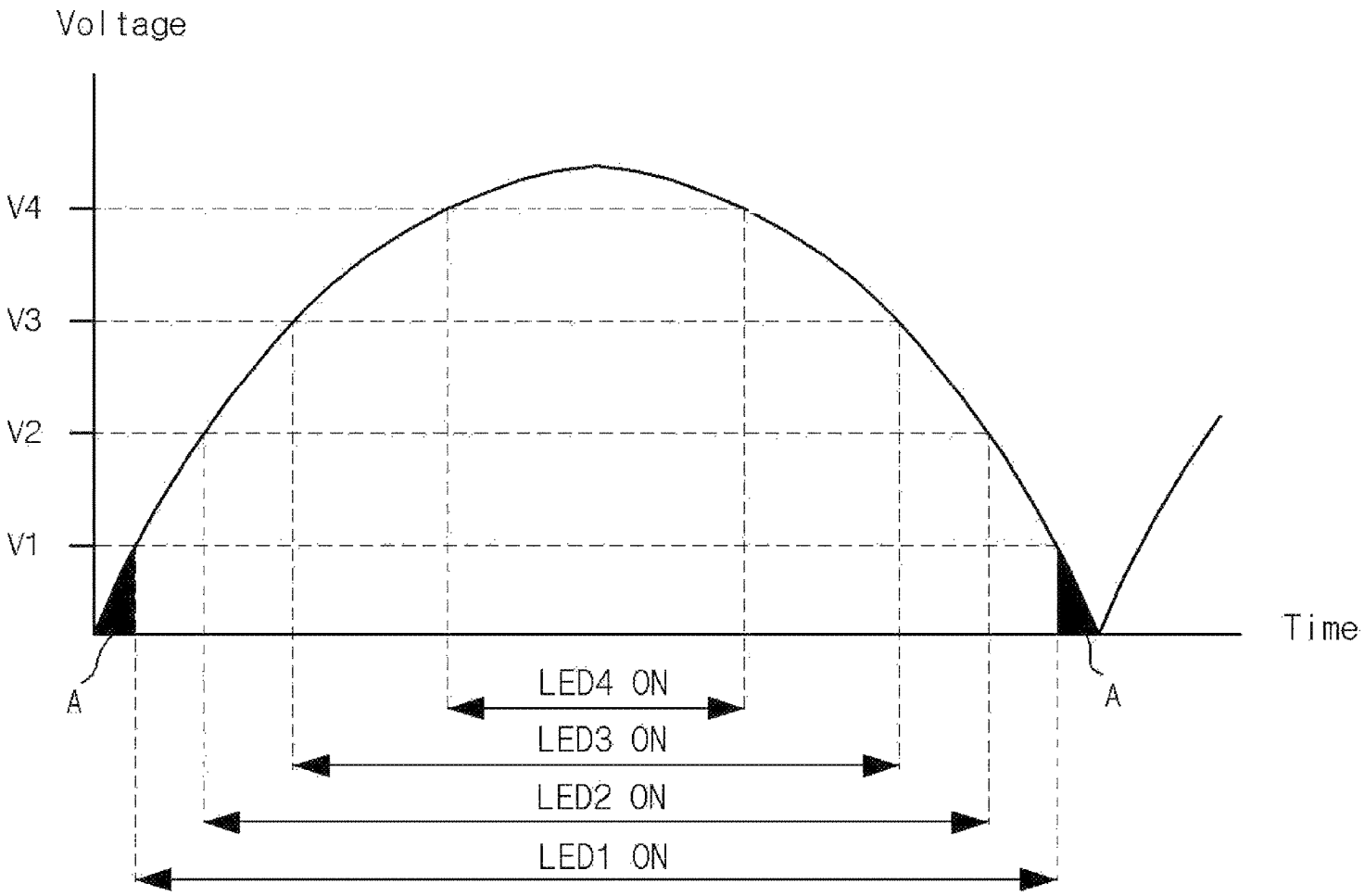
FIG. 2 is a waveform diagram for describing the operation of the embodiment of FIG. 1.

The rectifier circuit 12 full-wave rectifies the AC voltage having a waveform of which the phase is controlled by the triac 11, and outputs the rectified voltage. Thus, as illustrated in FIG. 2, the rectified voltage has a ripple at which the voltage level thereof is repetitively changed on a basis of a half cycle of the AC voltage.

The control unit includes a control unit 14 and a current sensing resistor Rs. The control unit 14 performs current regulation for light emission of the respective LED groups LED1 to LED4, and provides a current path through the current sensing resistor Rs of which one end is grounded.

According to the above-described configuration, the LED groups LED1 to LED4 of the lamp 10 are sequentially turned on or off in response to rises or falls of the rectified voltage, and the control unit 14 performs current regulation to selectively provide a current path for light emission of the respective LED groups LED1 to LED4.

The light emission voltage V4 is defined as a voltage for controlling all of the LED groups LED1 to LED4 to emit light, the light emission voltage V3 is defined as a voltage for controlling the LED groups LED1 to LED3 to emit light, the light emission voltage V2 is defined as a voltage for controlling the LED groups LED1 and LED2 to emit light, and the light emission voltage V1 is defined as a voltage for controlling only the LED group LED1 to emit light.

The control unit 14 may provide a current path by performing current regulation using the current sensing voltage of the current sensing resistor Rs, and the current sensing voltage may be varied by the current amount of the current path, which is changed according to the light emitting states of the respective LED groups of the lamp 10. At this time, the current flowing through the current sensing resistor Rs may include a constant current.

The control unit 14 includes a plurality of switching circuits 31 to 34 and a reference voltage supply unit 20. The plurality of switching circuits 31 to 34 provide a current path for the LED groups LED1 to LED4, and the reference voltage supply unit 20 provides reference voltages VREF1 to VREF4.

The reference voltage supply unit 20 includes a plurality of resistors R1 to R5 which are connected in series to receive a constant voltage VREF. The resistor R1 is connected to a ground, and the resistor R5 receives the constant voltage VREF and serves as a load resistor for adjusting an output. The resistors R1 to R4 serve to output the reference voltages VREF1 to VREF4 having different levels. Among the reference voltages VREF1 to VREF4, the reference voltage VREF1 may have the lowest voltage level, and the reference voltage VREF4 may have the highest voltage level.

The resistors R1 to R4 may have resistance values which are set to output four reference voltages VREF1 to VREF4 of which the levels gradually rise in response to variations of the rectified voltage applied to the LED groups LED1 to LDE4.

The reference voltage VREF1 has a level for turning off the switching circuit 31 at the point of time that the LED group LED2 emits light. More specifically, the reference voltage VREF1 may be set to a level equal to or lower than the current sensing voltage which is formed in the current sensing resistor Rs by the light emission voltage V2.

The reference voltage VREF2 has a level for turning off the switching circuit 32 at the point of time that the LED group LED3 emits light. More specifically, the reference voltage VREF2 may be set to a level equal to or lower than the current sensing voltage which is formed in the current sensing resistor Rs by the light emission voltage V3.

The reference voltage VREF3 has a level for turning off the switching circuit 33 at the point of time that the LED group LED4 emits light. More specifically, the reference voltage VREF3 may be set to a level equal to or lower than the current sensing voltage which is formed in the current sensing resistor Rs by the light emission voltage V4.

The reference voltage VREF4 may be set to a higher level than the current sensing voltage which is formed in the current sensing resistor Rs by the upper limit level of the rectified voltage.

The switching circuits 31 to 34 are commonly connected to the current sensing resistor Rs for providing the current sensing voltage.

The switching circuits 31 to 34 are turned on or off according to comparison results between the current sensing voltage of the current sensing resistor Rs to the reference voltages VREF1 to VREF4 of the reference voltage supply unit 20, and selectively provide a current path corresponding to the light emitting state of the lamp 10.

Each of the switching circuits 31 to 34 receives a high-level reference voltage as the switching circuit is connected to an LED group away from the position to which the rectified voltage is applied. Each of the switching circuits 31 to 34 may include a comparator 50 and a switching element, and the switching element may include an NMOS transistor 52.

The comparator 50 included in each of the switching circuits 31 to 34 receives the reference voltage through a positive input terminal (+) thereof, receives the current sensing voltage through a negative input terminal (−) thereof, and outputs the comparison result between the reference voltage and the current sensing voltage through an output terminal thereof.

According to the above-described configuration, the embodiment of FIG. 1 controls the lamp 10 to emit light and performs a current regulation operation for light emission of the lamp 10. This operation will be described with reference to FIG. 2.

When the rectified voltage is in the initial state, the plurality of LED groups LED1 to LED4 do not emit light. Thus, the current sensing resistor Rs may provide a low-level current sensing voltage.

In this case, all of the switching circuits 31 to 34 maintain the turn-on state, because the reference voltages VREF1 to VREF4 applied to the positive input terminals (+) of the respective switching circuits 31 to 34 are higher than the current sensing voltage applied to the negative input terminals (−).

Then, when the rectified voltage rises to reach the light emission voltage V1, the LED group LED1 of the lamp 10 emits light. When the LED group LED1 of the lamp 10 emits light, the turned-on switching circuit 31 of the control unit 14, connected to the LED group LED1, provides a current path.

When the rectified voltage reaches the light emission voltage V1 such that the LED group LED1 emits light, the current path is formed through the switching circuit 31, and the level of the current sensing voltage Vsense of the current sensing resistor Rs rises. At this time, however, since the level of the current sensing voltage is low, the turn-on states of the switching circuits 31 to 34 are not changed.

Then, when the rectified voltage continuously rises to reach the light emission voltage V2, the LED group LED2 of the lamp 10 emits light. When the LED group LED2 of the lamp 10 emits light, the turned-on switching circuit 32 of the control unit 14, connected to the LED group LED2, provides a current path. At this time, the LED group LED1 also maintains the light emitting state.

When the rectified voltage reaches the light emission voltage V2 such that the LED group LED2 emits light, the current path is formed through the switching circuit 32, and the level of the current sensing voltage Vsense of the current sensing resistor Rs rises. At this time, the current sensing voltage has a higher level than the reference voltage VREF1. Therefore, the NMOS transistor 52 of the switching circuit 31 is turned off by an output of the comparator 50. That is, the switching circuit 31 is turned off, and the turned-on switching circuit 32 provides a current path corresponding to the light emission of the LED group LED2.

Then, when the rectified voltage continuously rises to reach the light emission voltage V3, the LED group LED3 of the lamp 10 emits light. When the LED group LED3 of the lamp 10 emits light, the turned-on switching circuit 33 of the control unit 14, connected to the LED group LED3, provides a current path. At this time, the LED groups LED1 and LED2 also maintain the light emitting state.

When the rectified voltage reaches the light emission voltage V3 such that the LED group LED3 emits light, the current path is formed through the switching circuit 33, and the level of the current sensing voltage of the current sensing resistor Rs rises. At this time, the current sensing voltage has a higher level than the reference voltage VREF2. Therefore, the NMOS transistor 52 of the switching circuit 32 is turned off by an output of the comparator 50. That is, the switching circuit 32 is turned off, and the turned-on switching circuit 33 provides a current path corresponding to the turn-on of the LED group LED3.

Then, when the rectified voltage continuously rises to reach the light emission voltage V4, the LED group LED4 of the lamp 10 emits light. When the LED group LED4 of the lamp 10 emits light, the turned-on switching circuit 34 of the control unit 14, connected to the LED group LED4, provides a current path. At this time, the LED groups LED1 to LED3 also maintain the light emitting state.

When the rectified voltage reaches the light emission voltage V4 such that the LED group LED4 emits light, the current path is formed through the switching circuit 34, and the level of the current sensing voltage of the current sensing resistor Rs rises. At this time, the current sensing voltage has a higher level than the reference voltage VREF3. Therefore, the NMOS transistor 52 of the switching circuit 33 is turned off by an output of the comparator 50. That is, the switching circuit 33 is turned off, and the turned-on switching circuit 34 provides a selective current path corresponding to the light emission of the LED group LED4.

Then, although the rectified voltage continuously rises, the switching circuit 34 maintains the turn-on state, because the reference voltage VREF4 provided to the switching circuit 34 has a higher level than the current sensing voltage formed in the current sensing resistor Rs by the upper limit level of the rectified voltage.

The rectified voltage starts to falls after the upper limit level. When the rectified voltage falls below the light emission voltage V4, the LED group LED4 of the lamp 10 is turned off. When the LED group LED4 of the lamp 10 is turned off, the LED groups LED3, LED2, and LED1 maintain the light emitting state, and the control unit 14 provides a current path through the switching circuit 33 in response to the light emitting state of the LED group LED3.

Then, when the rectified voltage sequentially falls below the light emission voltages V3, V2, and V1, the LED groups LED3, LED2, and LED1 of the lamp 10 are sequentially turned off. As the LED groups LED3, LED2, and LED1 of the lamp 10 are sequentially turned off, the control unit 14 provides a selective current path in order of the switching circuits 33, 32, and 31.

The embodiment of FIG. 1 may include a flicker control unit 40, and the flicker control unit 40 includes a low angle detection unit 42, an abnormal waveform skip unit 44, and a driving unit 46.

The low angle detection unit 42 receives the rectified voltage supplied to the lamp 10, and outputs a low angle detection signal in order to prevent the occurrence of flicker at a low angle because a holding current is changed by a characteristic difference of the triac 11.

More specifically, the low angle detection unit 42 scales down the rectified voltage, determines whether the scaled-down rectified voltage is equal to or less than a preset voltage, and outputs the determination result as the low angle detection signal. Due to the characteristic difference by the triac 11, the holding current be changed, and a rectified voltage having a low angle may be supplied to the lamp 10, while having a level equal to or less than a permissible level. In this case, the lamp 10 may flicker due to the low-level rectified voltage. When a rectified voltage having a low angle and being equal to or less than a predetermined voltage is detected, the low angle detection unit 42 outputs a low angle detection signal for preventing flickering of the lamp 10.

That is, as illustrated in FIG. 2, the low angle detection unit 42 may set a region A in which the LED group LED1 is turned off to a low angle region, and detect that a rectified voltage having a low angle corresponding to the low angle region and being equal to or less than the preset level is provided to the lamp 10.

Figure 3:
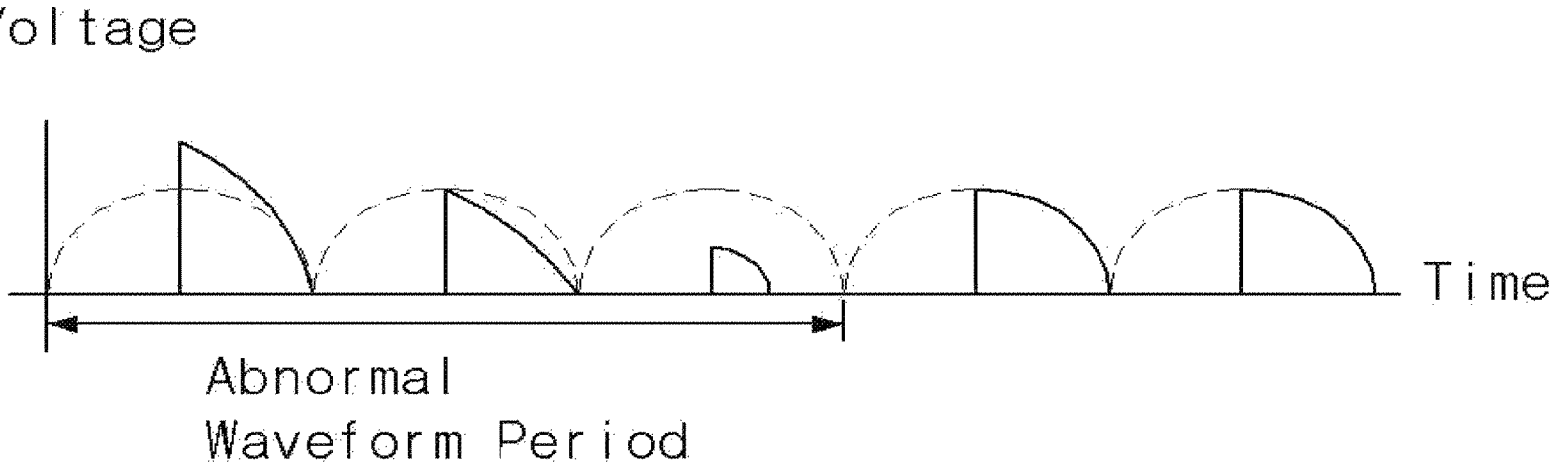
FIG. 3 is a diagram for describing a method of skipping an abnormal waveform.

The abnormal waveform skip unit 44 receives the rectified voltage supplied to the lamp 10, and outputs an abnormal waveform skip signal in response to an abnormal waveform period of the rectified voltage at the initial stage as illustrated in FIG. 3.

The abnormal waveform skip unit 44 may set a predetermined period of time to the abnormal waveform period, based on the point of time that the rectified voltage starts to be applied as illustrated in FIG. 3. Then, while counting a cycle, the abnormal waveform skip unit 44 may output an abnormal waveform skip signal during a preset cycle.

The initial rectified waveform may be abnormally provided to the lamp 10 during a predetermined time, due to the characteristic of the triac 11. Thus, the abnormal waveform skip unit 44 may output an abnormal waveform skip signal during a predetermined cycle, that is, during the period in which the abnormal waveform is detected.

The driving unit 46 may include a switching element which is driven by the low angle detection signal of the low angle detection unit 42 and the abnormal waveform skip signal of the abnormal waveform skip unit 44. The switching element may include an NMOS transistor Qc.

The driving unit 46 may be commonly connected to the gates of the switching elements included in the respective switching circuits 31 to 34, that is, the NMOS transistors 52.

The control unit 14 including the flicker control unit 40 configured in the above-described manner performs a control operation for a low angle and abnormal waveform of the rectified voltage, while performing current regulation in response to sequential turn-on/off of the respective LED groups of the lamp 10. Furthermore, the control unit 14 outputs a control signal for the control operation. The control signal may be defined as a signal applied by the NMOS transistor Qc of the driving unit 46.

The low angle detection unit 42 detects whether the rectified voltage having an angle controlled by the triac 11 has a level equal to or less than a preset voltage while having a low angle corresponding to the low angle region such as the region A of FIG. 2.

That is, the low angle detection unit 42 determines whether the rectified voltage has a low angle corresponding to the low angle region such as the region A of FIG. 1 and has a voltage level equal to or less than the preset voltage, in a state where the rectified voltage is scaled down. When the rectified voltage corresponds to a low angle and has a level equal to or less than the preset voltage, the low angle detection unit 42 outputs a low angle detection signal. For example, the low angle detection unit 42 may detect the light emission voltage V1 or the rectified voltage having a low angle equal to or less than a level which is slightly higher than the light emission voltage V1, and output a low angle detection signal in an enable state (for example, high level). The level which is slightly higher than the light emission voltage V1 may be set to a level at which flicker is likely to occur, and determined through an experiment.

When the low angle detection unit 42 is configured to detect a rectified voltage equal to or less than the light emission voltage V1, the low angle detection unit 42 outputs the low angle detection signal corresponding to the rectified voltage at a high level, the rectified voltage corresponding to the low angle region and being equal to or less than the light emission voltage V1.

The NMOS transistor Qc of the driving unit 46 maintains the turn-off state as the low-level low angle detection signal is applied in the initial normal state.

When the rectified voltage is equal to or less than the preset voltage and corresponds to the low angle region, the low angle detection unit 42 outputs the low angle detection signal at a high level, and the NMOS transistor Qc of the driving unit 46 is turned on. As the NMOS transistor Qc is turned on, the gate potentials of the NMOS transistors 52 of the switching circuits 31 to 34 is dropped to a low level.

Thus, when the rectified voltage equal to or less than the preset voltage level and having a low angle is inputted to the lamp 10 due to the characteristic of the triac 11, the lamp 10 maintains the turn-off state in response to the turn-off of the NMOS transistors 52 of the switching circuits 31 to 34. That is, according to the control of the driving unit 46 using the low angle detection signal, the turn-off state of the NMOS transistor 52 can be stabilized. As a result, an unstable situation or flicker caused by the characteristic of the dimmer 11 can be prevented.

Furthermore, when the rectified voltage starts to be applied as illustrated in FIG. 3, the abnormal waveform skip unit 44 outputs an abnormal waveform skip signal during a preset cycle based on the point of time that the rectified voltage is applied. That is, the abnormal waveform skip unit 44 outputs the abnormal waveform skip signal at a high level during the preset cycle from the point of time that the rectified voltage is applied.

The NMOS transistor Qc of the driving unit 46 maintains the turn-off state in response to the abnormal waveform skip signal which is provided at a low level in a normal state.

However, when the abnormal waveform skip unit 44 outputs the abnormal waveform skip signal at a high level, the NMOS transistor Qc of the driving unit 46 is turned on. As the NMOS transistor Qc is turned on, the gate potentials of the NMOS transistors 52 of the switching circuits 31 to 34 are dropped to a low level.

Thus, the abnormal waveform skip signal maintains a high level during the cycle in which the abnormal waveform is applied at the initial stage of the rectified voltage due to the characteristic of the triac 11, and the NMOS transistors of the switching circuits 31 to 34 maintain the turn-off state in response to the high-level abnormal waveform skip signal. That is, according to the control of the driving unit 46 using the abnormal waveform skip signal, light emission of the lamp 10 by the rectified voltage having an unstable waveform at the initial stage can be skipped.

As a result, it is possible to prevent the occurrence of flicker in the lamp 10 by the rectified voltage having an unstable waveform at the initial stage due to the triac 11.

FIG. 1 illustrates that the driving unit 46 is commonly connected to the switching circuits 31 to 34. However, the present invention is not limited thereto, but a plurality of driving units 46 may correspond one-to-one to the respective switching circuits 31 to 34. At this time, the low angle detection signal of the low angle detection unit 42 and the abnormal waveform skip signal of the abnormal waveform skip unit 44 may be commonly provided by the plurality of driving units 46.

Figure 4:
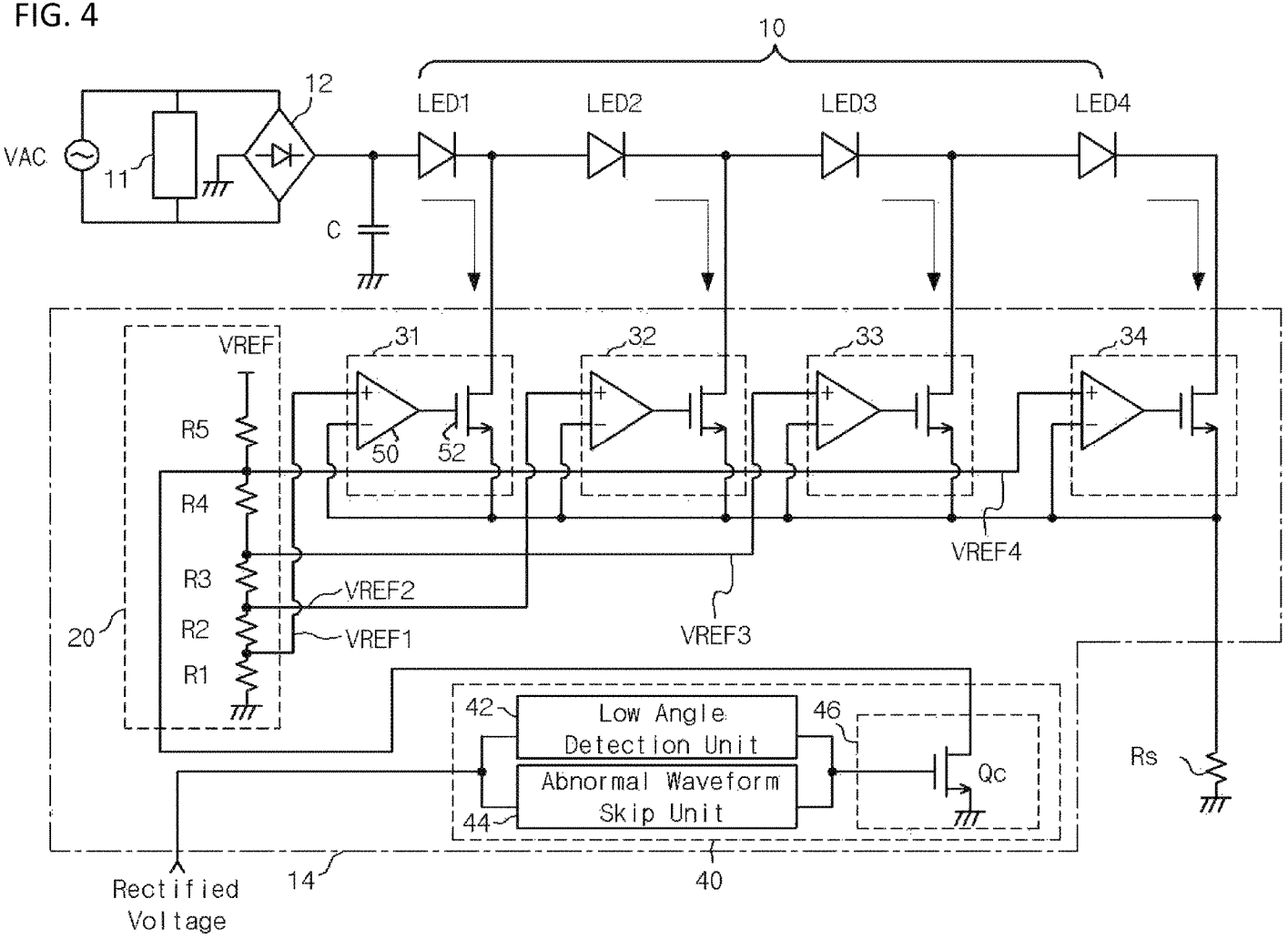
FIG. 4 is a circuit diagram illustrating a modification of FIG. 1.

Furthermore, as illustrated in FIG. 4, the present embodiment may control the light emission of the lamp 10 by adjusting the reference voltages of the reference voltage supply unit 20, unlike the configuration FIG. 1. As a result, the occurrence of flick may be reduced.

In the embodiment of FIG. 4, the same parts as those of FIG. 1 are represented by like reference numerals, and the duplicated descriptions thereof are omitted herein.

In the embodiment of FIG. 4, the driving unit 46 is connected to a node between the resistors R5 and R4 of the reference voltage supply unit 20.

That is, the NMOS transistor Qc of the driving unit 46 has a source connected to the node which outputs the reference voltage having the highest level among the nodes of the resistors included in the reference voltage supply unit 20.

According to the above-described configuration, the driving unit 46 is turned on when the low angle detection signal of the low angle detection unit 42 and the abnormal waveform skip signal of the abnormal waveform skip unit 44 are applied at a high level.

The level of the node between the resistors R5 and R4 of the reference voltage supply unit 20 falls to the ground voltage when the NMOS transistor Qc of the driving unit 46 is turned on, and rises to the reference voltage VREF4 when the NMOS transistor Qc of the driving unit 46 is turned off. Furthermore, the voltages of the nodes from which the other reference voltages VREF1, VREF2, and VREF3 are outputted also swing between the ground voltage and the respective reference voltages in connection with the operation of the driving unit 46.

When the NMOS transistor Qc of the driving unit 46 is turned on in response to the period in which the low angle detection signal and the abnormal waveform skip signal are applied at a high level, all of the levels of the reference voltages VREF1 to VREF4 fall to the ground voltage. In this case, each of the comparators 50 outputs a low-level voltage to the gate of the transistor 52. In connection with the operations of the comparators 50, the gate voltages of the NMOS transistors 52 included in the switching circuits 31 to 34 are turned off, and the current path is blocked.

When the NMOS transistor Qc of the driving unit 46 is turned off in response to a normal period in which the low angle detection signal and the abnormal waveform skip signal are applied at a low level, the levels of the reference voltages VREF1 to VREF4 are recovered. Thus, the comparators of the switching circuits 31 to 34 perform a normal operation according to the level of the rectified voltage.

Thus, while the low angle detection signal and the abnormal waveform skip signal are outputted at a high level due to the characteristic of the triac 11, the NMOS transistors 52 of the switching circuits 31 to 34 stably maintain the turn-off state. As a result, an unstable situation or flicker of the lamp 10 caused by the characteristic of the triac 11 or environment factors can be prevented.

As such, the embodiment of FIG. 4 can also prevent an unstable situation or flicker of the lamp 10 caused by the characteristic of the triac 11 or environment factors, like the embodiment of FIG. 1.

Therefore, the LED lighting apparatus and the control circuit thereof in accordance with the embodiment of the present invention may employ the dimmer using the triac to perform the bright control function, and reduce flicker occurring in a low angle region of the rectified voltage or flicker caused by an abnormal waveform of the rectified voltage at the initial stage, thereby stably driving the LED lighting apparatus.

While various embodiments have been described above, it will be understood to those skilled in the art that the embodiments described are by way of example only. Accordingly, the disclosure described herein should not be limited based on the described embodiments.

The invention claimed is:

1. A control circuit of an LED lighting apparatus, which controls a lamp divided into a plurality of LED groups to emit light in response to a rectified voltage outputted through a dimmer using a triac, the control circuit comprising:

a reference voltage supply unit configured to provide reference voltages having different levels to the respective LED groups;

a flicker control unit configured to provide a control signal in response to the rectified voltage having a low angle corresponding to a preset low angle region and equal to or less than a preset level; and a plurality of switching circuits configured to selectively provide a current path in response to light emission of the LED groups, perform current regulation for selectively providing the current path by comparing the reference voltages of the respective LED groups to a current sensing voltage corresponding to the current amount of the current path, and turn off the current path in response to the control signal, wherein the control circuit controls flicker caused by a change of the rectified voltage which occurs due to the triac.

2. The control circuit of claim 1, wherein the flicker control unit comprises:

a low angle detection unit configured to output a low angle detection signal in response to the rectified voltage having the low angle corresponding to the preset low angle region and equal to or less than the preset level; and a driving unit configured to output the control signal corresponding to the low angle detection signal.

3. A control circuit of an LED lighting apparatus, which controls a lamp divided into a plurality of LED groups to emit light in response to a rectified voltage outputted through a dimmer using a triac, the control circuit comprising:

a reference voltage supply unit configured to provide reference voltages having different levels to the respective LED groups;

a flicker control unit configured to detect an initial abnormal waveform period of the rectified voltage and provide a control signal corresponding to the abnormal waveform period; and a plurality of switching circuits configured to selectively provide a current path in response to light emission of the LED groups, perform current regulation for selectively providing the current path by comparing the reference voltages of the respective LED groups to a current sensing voltage corresponding to the current amount of the current path, and turn off the current path during the abnormal waveform period in response to the control signal, wherein the control circuit controls flicker caused by a change of the rectified voltage which occurs due to the triac.

4. The control circuit of claim 3, wherein the flicker control unit further provides the control signal in response to the rectified voltage having a low angle corresponding to a preset low angle region and equal to or less than a preset level.

5. The control circuit of claim 4, wherein the flicker control unit comprises:

a low angle detection unit configured to output a low angle detection signal in response to the rectified voltage having the low angle corresponding to the preset low angle region and equal to or less than the preset level;

an abnormal waveform skip unit configured to detect the initial abnormal waveform period of the rectified voltage and provide an abnormal waveform skip signal corresponding to the abnormal waveform period; and a driving unit configured to output the control signal corresponding to the low angle detection signal and the abnormal waveform skip signal.

6. The control circuit of claim 3, wherein the flicker control unit comprises:

an abnormal waveform skip unit configured to detect the initial abnormal waveform period of the rectified voltage and provide an abnormal waveform skip signal corresponding to the abnormal waveform period; and a driving unit configured to output the control signal corresponding to the abnormal waveform skip signal.

7. The control circuit of claim 1, wherein the flicker control unit provides the control signal to switching elements included in the respective switching circuits, and turns off the current path.

8. The control circuit of claim 7, wherein each of the switching circuits comprises:

a comparator configured to compare the reference voltage to the current sensing voltage and output the comparison result; and a switching element configured to selectively provide the current path according to the control signal and the output of the comparator.

9. A control circuit of an LED lighting apparatus, which controls a lamp divided into a plurality of LED groups to emit light in response to a rectified voltage outputted through a dimmer using a triac, the control circuit comprising:

a flicker control unit configured to provide a control signal corresponding to the rectified voltage having a low angle corresponding to a preset low angle region and equal to or less than a preset level or detect an initial abnormal waveform period of the rectified voltage and provide a control signal corresponding to the abnormal waveform period;

a reference voltage supply unit configured to provide reference voltages having different levels to the respective LED groups, and vary the output levels of the reference voltages in response to the control signal; and a plurality of switching circuits configured to selectively provide a current path in response to light emission of the LED groups, perform current regulation for selectively providing the current path by comparing the reference voltages of the respective LED groups to a current sensing voltage corresponding to the current amount of the current path, and turn off the current path in response to the level changes of the reference voltages by the control signal.

10. The control circuit of claim 9, wherein the reference voltage supply unit comprises a plurality of resistors connected in series, nodes for the respective resistors output the reference voltages having different levels to the respective LED groups, and the control signal is applied to the node which outputs the reference voltage having the highest level.

11. An LED lighting apparatus comprising:

a lamp comprising a plurality of LEDs divided into a plurality of LED groups which sequentially emit light;

a power supply unit comprising a triac and configured to provide a rectified voltage to the lamp using an AC voltage having a phase controlled through the triac;

a control circuit configured to selectively provide a current path in response to light emission of the LED groups, provide the current path by comparing reference voltages supplied at different levels to the respective groups to a current sensing voltage corresponding to the current amount of the current path, and turn off the current path in response to the rectified voltage having a low angle corresponding to a preset low angle region and equal to or less than a preset level or detect an initial abnormal waveform period of the rectified voltage and turn off the current path in response to the abnormal waveform period; and a current sensing element configured to provide the current sensing voltage for the current path.

12. The LED lighting apparatus of claim 11, wherein the control circuit comprises:

a reference voltage supply unit configured to provide reference voltages having different levels to the respective LED groups;

a flicker control unit configured to a control signal corresponding to the rectified voltage having the low angle corresponding to the preset low angle region and equal to or less than the preset level or detect the initial abnormal waveform period of the rectified voltage and provide a control signal corresponding to the abnormal waveform period; and a plurality of switching circuits configured to selectively provide the current path in response to light emission of the LED groups, perform current regulation for selectively providing the current path by comparing the reference voltages of the respective LED groups to the current sensing voltage, and turn off the current path during the abnormal waveform period in response to the control signal.

13. The LED lighting apparatus of claim 11, wherein the control circuit comprises:

a flicker control unit configured to provide a control signal corresponding to the rectified voltage having the low angle corresponding to the preset low angle region and equal to or less than the preset level or detect the initial abnormal waveform period of the rectified voltage and provide a control signal corresponding to the abnormal waveform period;

a reference voltage supply unit configured to provide the reference voltages having different levels to the respective LED groups, and vary the output levels of the reference voltages in response to the control signal; and a plurality of switching circuits configured to selectively provide the current path in response to light emission of the LED groups, perform current regulation for selectively providing the current path by comparing the reference voltages of the respective LED groups to the current sensing voltage, and turn off the current path in response to the level changes of the reference voltage by the control signal.

14. The control circuit of claim 3, wherein the flicker control unit provides the control signal to switching elements included in the respective switching circuits, and turns off the current path.

* * * * *